US007048524B2

(12) United States Patent
Manfredini et al.

(10) Patent No.: US 7,048,524 B2
(45) Date of Patent: May 23, 2006

(54) INTERNAL GEAR PUMP WITH RECESSES ON THE GEAR BEARING SURFACES

(75) Inventors: Giorgio Manfredini, Cavezzo (IT); Uber Bortoli, Mirandola (IT)

(73) Assignee: CPS Color Equipment SpA, San Felice sul Panaro (IT)

( * ) Notice: Subject to any disclaimer, the term of this patent is extended or adjusted under 35 U.S.C. 154(b) by 0 days.

(21) Appl. No.: 10/509,625

(22) PCT Filed: Mar. 28, 2003

(86) PCT No.: PCT/IB03/01233

§ 371 (c)(1),
(2), (4) Date: Sep. 29, 2004

(87) PCT Pub. No.: WO03/083306

PCT Pub. Date: Oct. 9, 2003

(65) Prior Publication Data

US 2005/0152803 A1 Jul. 14, 2005

(30) Foreign Application Priority Data

Mar. 29, 2002 (IT) ..... BO2002A0167

(51) Int. Cl.
*F04C 2/00* (2006.01)

(52) U.S. Cl. ..... 418/171; 418/75; 418/77; 418/79

(58) Field of Classification Search ..... 418/75, 418/77, 79, 166, 168, 171, 151
See application file for complete search history.

(56) References Cited

U.S. PATENT DOCUMENTS

| | | | | |
|---|---|---|---|---|
| 3,331,258 | A | 7/1967 | Eckerle et al. | |
| 3,374,748 | A * | 3/1968 | Marsh | 418/169 |
| 3,887,310 | A * | 6/1975 | Gerber | 418/72 |
| 5,156,540 | A * | 10/1992 | Fernau et al. | 418/171 |
| 6,062,836 | A | 5/2000 | Julicher et al. | |
| 6,352,419 | B1 * | 3/2002 | Thompson et al. | 418/104 |
| 6,568,929 | B1 * | 5/2003 | Takagi | 418/171 |

FOREIGN PATENT DOCUMENTS

| | | | |
|---|---|---|---|
| DE | 18 02 561 U | | 12/1959 |
| DE | 29810548 U1 | * | 12/1998 |
| EP | 0 555 173 A | | 8/1993 |
| EP | 0 696 679 A | | 2/1996 |
| FR | 2 562 959 A | | 10/1985 |
| JP | 03202686 A | * | 9/1991 |
| JP | 11 247 766 A | | 9/1999 |

* cited by examiner

*Primary Examiner*—Theresa Trieu
(74) *Attorney, Agent, or Firm*—Sughrue Mion, PLLC

(57) ABSTRACT

A positive-displacement pump, in particular for use in machines or dispensing fluids, including two elements that are with respect to one another and which mesh with one another (20, 30), each of them being rotatably mounted in the pump with centered coupling without interference with a corresponding centering body (18, 11*a*). At least one of the two above-mentioned ratable elements has a plurality of undercut regions (26, 34, 35) at the location of the centering walls. The undercut regions (26, 34, 35) comprise a wall portion which is spaced with respect to the facing wall of the respective centering body.

5 Claims, 1 Drawing Sheet

INTERNAL GEAR PUMP WITH RECESSES ON THE GEAR BEARING SURFACES

This is a National Stage entry of Application No. PCT/IB03/01233 filed Mar. 28, 2004; the disclosure of which is incorporated herein by reference.

BACKGROUND OF THE INVENTION

The present invention relates to improvements to a rotary positive-displacement pump for fluid products.

The invention has been developed with particular but not exclusive regard to a pump for use in machines for dispensing colouring agents for the production of paints, varnishes, inks and the like.

Positive-displacement pumps of the rotary type having internal gears are known. One of these pumps is illustrated in FIG. 1 appended to the present description and is the subject of patent IT-1292625 belonging to the same applicant, the content of which is regarded as incorporated by reference in the present description. The known pump illustrated comprises a rotor 13 mounted on the end of a main shaft 12. The rotor 13 has peripheral teeth 15 that can mesh with teeth 16 of an idle sprocket 17 which is supported in rotation by a pin 18 of a conveying body 19.

Despite the generally satisfactory operation of the above-mentioned known positive-displacement pump, in a few particular cases some malfunctions have been encountered which have led to the jamming of the idle sprocket 17 on the pin 18 and of the rotor 13 inside the cylindrical cavity 11*a* of the body 11 of the pump (illustrated diagrammatically in FIG. 1). In particular, the above-mentioned malfunctions have occurred when the positive-displacement pump has been used with some types of colouring product that, owing to the particular chemical composition, promote the creation of a sticky film. It has been found that this sticky film can penetrate and become wedged between the idle sprocket 17 and its support pin 18, and also between the outer curved surface of the rotor 13 and the associated cylindrical housing 11*a* in the body 11 of the pump, until it causes the complete jamming of the rotating elements.

SUMMARY OF THE INVENTION

In order to overcome the disadvantages indicated above and at the same time to provide a reliable pump, but without having any substantial effect on the production and running costs, the present invention relates to a positive-displacement pump having the characteristics indicated in the claims which follow.

BRIEF DESCRIPTION OF THE DRAWINGS

Further features and advantages will emerge from the following detailed description of a preferred embodiment, with reference to the appended drawings which are given purely by way of non-limiting example and in which.

DETAILED DESCRIPTION OF THE INVENTION

Figure 1:
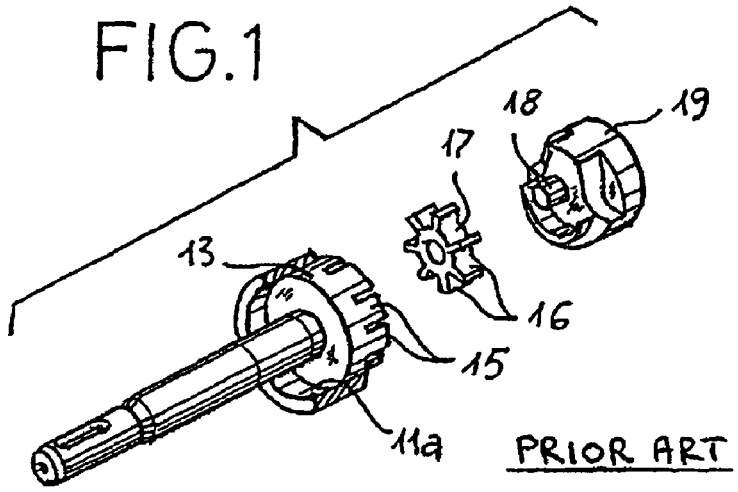
FIG. 1 shows a pump arrangement of the prior art, as discussed above.
Figure 2:
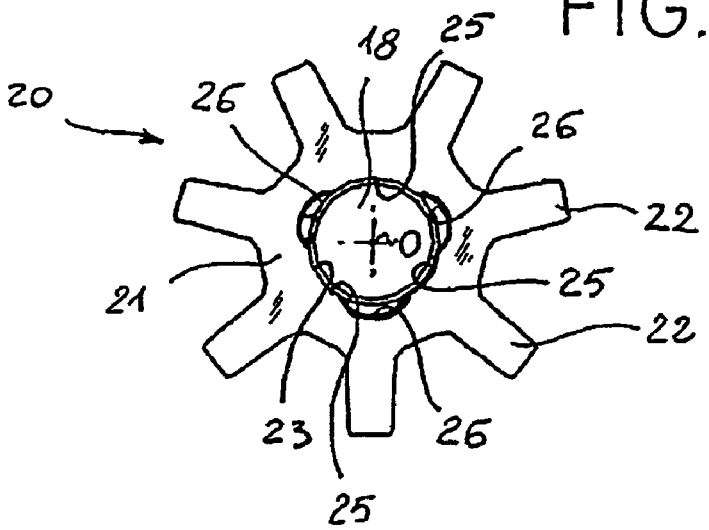
FIG. 2 is a front view of an idle sprocket of a pump according to the present invention, which sprocket is mounted on the associated support pin.

Referring now to FIG. 2, an idle sprocket 20, which is to be mounted in rotary positive-displacement pumps of a generally known type illustrated by way of example in FIG. 1, comprises a body 21 from which a plurality of teeth 22 extend radially. The idle sprocket 20 has a central opening 23 in which, in use, the pin 18 of the conveying body 19 is accommodated. In the embodiment illustrated in FIG. 2, the central opening 23 has a series of centring portions 25 which are in the shape of an arc of a circle with a centre O, coinciding with the centre of the pin 18. Interposed between the curved centring portions 25 are undercut portions 26 at the location of which the internal wall of the central opening 23 of the idle sprocket 20 is spaced from the peripheral cylindrical portion of the pin 18. In the embodiment illustrated in the drawing, the central opening 23 comprises three centring portions 25 alternating with as many undercut portions 26, but the number and location of the above-mentioned portions of the central opening 23 can of course vary in accordance with the specific requirements of use of the positive-displacement pump and the particular fluid to be treated.

Figure 3:
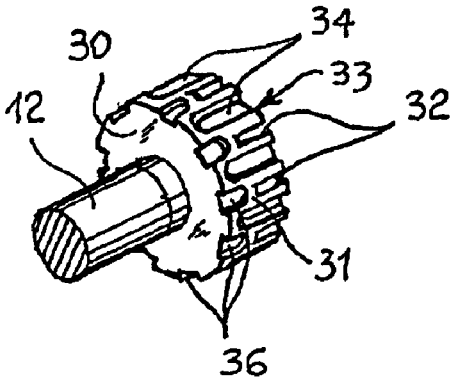
FIGS. 3 and 4 are perspective representations, on an enlarged scale, of two alternative embodiments of a rotor of a pump according to the present invention.

FIG. 3 illustrates an embodiment of a rotor 30 for a positive-displacement pump according to the present invention. In more detail, the rotor 30 has a cylindrical peripheral curved surface 31 which has first peripheral notches 32 defining a plurality of peripheral teeth 33 which can mesh with the teeth 22 of the idle sprocket 20. The outer face of each peripheral tooth 33 has, between two adjacent peripheral notches 32, depressions 34 which help to reduce the surface area of the peripheral curved surface 31 of the rotor 30 which, in use, is coupled without interference in the corresponding cylindrical cavity 11*a* provided in the body 11 of the positive-displacement pump. Other depressions 36 are provided for the same reason on the peripheral curved surface 31, in a position aligned longitudinally with the peripheral notches 32.

Figure 4:
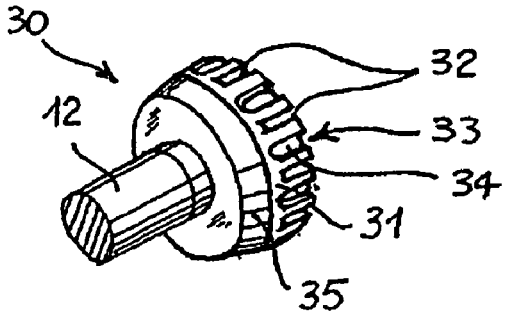

FIG. 4 illustrates a variant of the rotor 30 in which, in addition to the depressions 34 formed on the outer face of each peripheral tooth 33, an annular depression or chamfer 35 may be provided on a portion of the peripheral curved surface 31 remote from the peripheral teeth 33, again for the purpose of reducing the surface area of the peripheral curved surface 31 coupled in rotation without interference to the corresponding cavity 11*a* provided in the body 11 of the positive-displacement pump.

During the operation of the pump according to the present invention, the rotor 30 is operated in rotation by the shaft 12 and rotates accommodated inside the corresponding cylindrical cavity 11*a*, provided in the body 11 of the pump, on which the peripheral curved surface 31 is centred. The size of the cylindrical regions of the peripheral curved surface 31 that are not affected by the depressions 34, 36 and/or by the chamfer 35 is sufficient to maintain a good centring of the rotor inside the pump body. The depressions 34 appear also to help to break any film which might form inside the fluid product, in particular the colouring product in use.

The peripheral teeth 33 of the rotor 30 mesh, as is known, with the teeth 22 of the idle sprocket 20, driving the latter in rotation about the pin 18. In this case too, the curved centring portions 25 of the central opening 23 are sufficient to maintain the correct centring of the idle sprocket 20 on the pin 18, while the curved undercut portions 26, in addition to reducing the surface area of the idle sprocket 20 in contact with the pin 18, appear to help to break or prevent the formation of a film inside the fluid product in use.

Naturally, the principle of the invention remaining the same, the forms of embodiment and the details of construction may be varied widely with respect to those described and illustrated, without thereby departing from the scope of the present invention.

The invention claimed is:

1. A positive-displacement pump, in particular for use in machines for dispensing fluids, comprising a body having a cylindrical cavity, a rotor (30) mounted rotatably inside said cylindrical cavity (11*a*) and having a peripheral curved surface (31) for defining a centered coupling without interference into said cylindrical cavity, wherein peripheral notches (32) are provided on the cylindrical peripheral curved surface (31) of said rotor (30) to define a plurality of peripheral teeth (33), an idle sprocket (20) being rotatably mounted without interference with a centering body (18) and having a plurality of teeth (16) meshed with said plurality of peripheral teeth (33) of said rotor (30), wherein portions of an undercut wall (35, 36) spaced from the cylindrical cavity and elongated in the direction of the axis of rotation of said rotor (30) are provided on the peripheral curved surface (31) of said rotor (30), and at least one depression (34) is provided on the outer face of each peripheral tooth (33) between two adjacent peripheral notches (32).

2. A positive-displacement pump according to claim 1, wherein said idle sprocket (20) is mounted rotatably on a pin (18), said idle sprocket (20) having a central opening comprising portions of a centering wall (23) which define the centered coupling of said idle sprocket (20) to said pin (18) and which alternate with portions of undercut wall (26) spaced from said pin (18).

3. A positive-displacement pump according to claim 2, wherein the central opening comprises three portions of said centering wall (23).

4. A positive-displacement pump according to claim 1, wherein second depressions (36) are provided on the cylindrical peripheral curved surface (31) of said rotor (30), in a position aligned longitudinally with said peripheral notches (32).

5. A positive-displacement pump according to claim 1, wherein an annular chamfer (35) is formed on a portion of said peripheral curved surface (31) remote from said plurality of peripheral teeth (33).

* * * * *